US005172429A

United States Patent [19]

Lucier

[11] Patent Number: 5,172,429

[45] Date of Patent: Dec. 22, 1992

[54] COMBINATION SUSPENDERS FOR USE WITH BUTTON AND BUTTONLESS TROUSERS

[75] Inventor: Cyril Lucier, Niantic, Conn.

[73] Assignee: New England Accessories, Old Saybrook, Conn.

[21] Appl. No.: 714,496

[22] Filed: Jun. 13, 1991

[51] Int. Cl.[5] ..... A41F 1/00; A41F 15/00; A41F 3/00

[52] U.S. Cl. ..... 2/326; 2/300; 2/304; 2/307; 2/308; 2/332; 2/336; 2/340; 24/265 EC

[58] Field of Search ..... 2/300, 301, 302, 303, 2/304, 305, 306, 307, 308, 309, 310, 311, 312, 313-336, 338, 339; 24/265 EC, 265 H, 301, 302

[56] References Cited

U.S. PATENT DOCUMENTS

| | | | |
|---|---|---|---|
| 457,448 | 4/1891 | Clawson | 2/307 |
| 622,349 | 4/1899 | Halstenbach | 2/325 |
| 648,257 | 4/1900 | Heyman | 2/307 |
| 734,861 | 7/1903 | Harris | 2/307 |
| 900,090 | 10/1908 | Fisher | 2/332 |
| 1.221,966 | 4/1917 | Brown | 2/307 |
| 1,800,671 | 4/1931 | Zimmerer et al. | 2/325 |
| 1,803,214 | 4/1931 | Siegel | 2/319 |
| 1,823,369 | 9/1931 | McCulloch | 2/324 |
| 1,962,021 | 6/1934 | Lobbenberg | 2/325 |
| 2,040,635 | 5/1936 | Sobel | 2/323 |

FOREIGN PATENT DOCUMENTS

| | | | |
|---|---|---|---|
| 46353 | 5/1933 | Denmark | 2/307 |
| 124748 | 3/1928 | Switzerland | 2/307 |

*Primary Examiner*—Werner H. Schroeder
*Assistant Examiner*—Jeanette E. Chapman
*Attorney, Agent, or Firm*—DeLio & Associates

[57] ABSTRACT

A combination suspenders for use with button and buttonless trousers includes interchangeable clip ends and button strap ends connected to the suspender straps via a clip carrier. The clip carrier is formed of a horizontally folded flexible material forming a channel which engages a button strap end or a connector on the clip end having a pair of horizontally extending opposed arms. In one embodiment, the clip connector is T-shaped with outwardly extending arms and engages the channel via a slit which vertically bisects the channel into opposed halves. In another embodiment, the clip connector is C-shaped and engages the channel from the outside with inwardly extending arms.

4 Claims, 2 Drawing Sheets

COMBINATION SUSPENDERS FOR USE WITH BUTTON AND BUTTONLESS TROUSERS

BACKGROUND OF THE INVENTION

1. Field of the Invention

This invention relates to suspenders of the type which are worn over the shoulders to support trousers. More specifically, this invention relates to combination suspenders which may be used with pants having suspender buttons, as well as with pants lacking such buttons, by providing interchangeable connectors at the end of the suspender straps.

2. Description of Related Art

Some trousers are provided with buttons inside the waistband for connection to suspenders having buttonholes on button strap connectors at the end of the suspender straps. Other types of trousers are not provided with suspender buttons, and suspenders for use with these trousers include clips with a pair of clampable jaws to engage the waistband.

The button type of suspenders are preferred by many, but they are incompatible with trousers lacking the buttons, requiring that the owner of both types of trousers obtain multiple sets of suspenders.

One object of the present invention is to provide a waistband connection end for suspenders which may easily be converted between a button strap end with buttonholes and a clip end with clampable jaws.

Another object of the invention is to provide a rugged, reliable, inexpensively manufactured connector end which does not accidentally disengage from the suspender strap end.

A further object of the invention is to provide connector ends with horizontally extending arms which may be engaged and disengaged from the suspender straps conveniently by simply manipulating the connector ends relative to the suspender strap ends without unfastening buckles, buttons or snaps.

Still other objects and advantages of the invention will in part be obvious and will in part be apparent from the specification.

SUMMARY OF THE INVENTION

A combination suspenders according to the present invention includes multiple suspender straps, one end of each strap being adapted for connection to a clip carrier. A clip carrier is connected to each corresponding suspender strap. The upper end of each clip carrier is connected to its corresponding suspender strap and the lower end of each clip carrier comprises a horizontally folded flexible material forming a clip carrier channel.

Each clip carrier is provided with a button strap having a central section extending through the clip carrier channel and a buttonhole at each end. The compressed diameter of the button strap is less than the inside diameter of the channel so that the button strap may be pulled from the channel.

Each clip carrier is also provided with a clip having a pair of jaws at its lower end for connecting the clip to the waistband of the trousers. The upper end of the clip is provided with a pair of horizontally extending arms extending into and being supported by the clip carrier channel.

Each clip is removable from its corresponding clip carrier by manipulating the flexible clip carrier to disengage the clip arms from the carrier channel.

In one embodiment, the clip connector has horizontal outwardly extending arms, referred to herein as "T-shaped" The base of the "T" is connected to the jaws, the body of the "T" extends vertically through a slit in the carrier channel that bisects it into opposed halves, and the upper arms of the "T" extend horizontally into the opposite halves of the clip carrier channel. In this embodiment, the clips are removable from their corresponding clip carrier by spreading the slit to disengage the T-shaped connector.

In another embodiment, the clip connector has horizontal inwardly extending arms, referred to herein as "C-shaped" The clip carrier includes a narrow width section which is preferably located on the back side of the clip carrier. Each clip is removable from its corresponding clip carrier by manipulating the narrow width section of the clip carrier between the arms to disengage the C-shaped connector.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DESCRIPTION OF THE PREFERRED EMBODIMENTS

Figure 1:
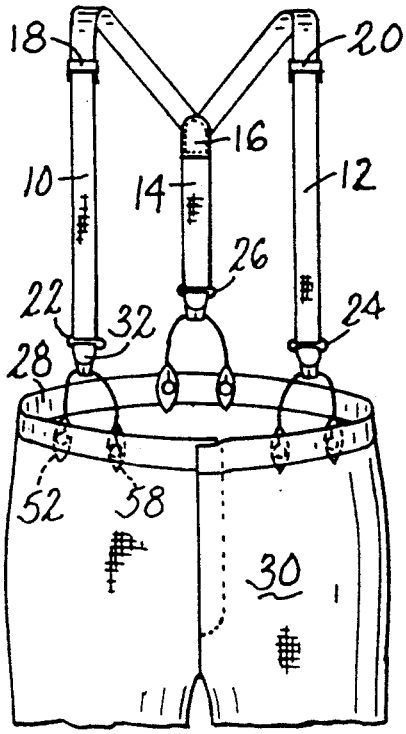
FIG. 1 is a perspective view showing the combination suspenders with the clip ends removed and attached by the button strap ends to the buttons on the waistband of a pair of trousers.

Referring to FIG. 1, the suspenders of the invention includes front suspender straps 10 and 12 connected to a rear suspender strap 14 at a common connection point 16.

The front suspender straps 10, 12 extend from their attachment to the common connection point 16 through adjustment buckles 18, 20 of a conventional type, down to connection rings 22, 24 and back up, where they are secured to buckles 18, 20. Adjustment is provided by loosening buckles 18, 20, sliding them into the proper position along the front suspender straps, and then clamping them into the new position.

The rear strap 14 extends from the common connection point 16 through a connection ring 26 and back up to the connection point 16. The straps 10, 12, 14 may be made of cloth, leather or an elastic material. Preferably, the rear strap 14 is elastic to provide an elastic pulling force for the front two straps which are often made of a decorative cloth.

Figure 2:
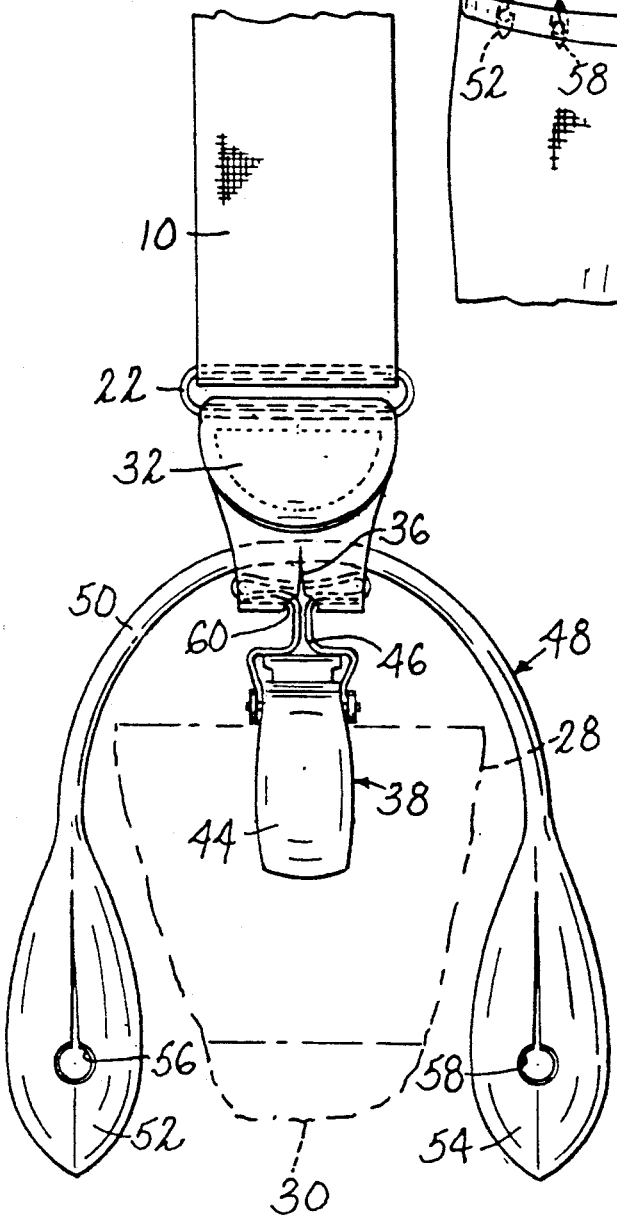
FIG. 2 is a detail front view of an end of a suspenders strap showing both a clip end and a button strap end as the combination suspenders would be stored or sold.

Each of the three strap ends connected to the waistband 28 of the trousers 30 is identical and accordingly all of the views, except FIG. 1, show only a detail view of the end of strap 10 in various configurations. Referring to FIG. 2, it can be seen that strap 10 is connected to clip carrier 32 via the connection ring 22.

Clip carrier 32 is formed of a folded and sewn flexible material, such as leather, cloth or the like. The upper end of the clip carrier passes through the connection ring 22, and is folded down and sewn upon itself to provide a secure connection to the end of strap 10.

Figure 3:
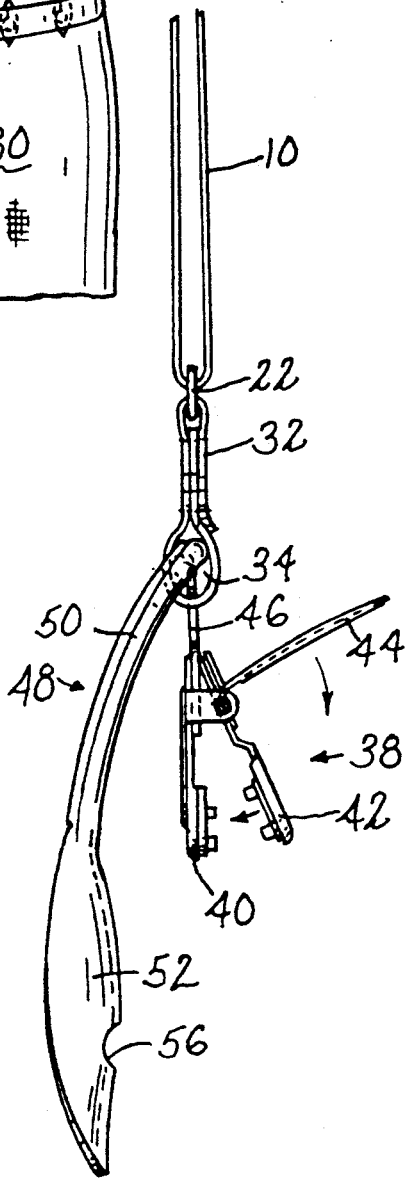
FIG. 3 is a detail side view showing a suspender end with the clip end and its associated jaws in the open position.

As can be seen best in the side view of FIG. 3, the lower end of clip carrier 32 is horizontally folded to form a clip carrier channel 34. Referring back to FIG. 2, it can be seen that in this embodiment, channel 34 is vertically bisected into opposed halves by slit 36 which extends from just below the sewn portion of the clip carrier 32, down through the folded channel and up to a corresponding height at the back of the clip carrier.

Clip 38 includes a pair of jaws, 40, 42 which are openable and closeable via latching lever 44. The clip 38 is connected to the clip carrier 32 via T-shaped connector 46. The T-shaped connector 46 has the base of the "T" connected to the jaws of the clip. The body of the "T" extends vertically through the slit 36, and the upper arms of the "T" extend horizontally outward into the opposed halves of the clip carrier channel 34 where they are suspended.

The T-shaped connector 46 is preferably formed from a single piece of bent wire which extends from the base of the "T", up the body of the "T", out to the tip of one arm of the "T", across the top of the "T" to the tip of the other arm, back to the body of the "T" and down to the base of the T. In this manner, each section of the "T" is formed of a doubled piece of wire and the tips of the arms of the "T" are formed with smooth rounded ends. These arms extend to a width which is as wide as, or just wider than, the base of the clip carrier 32. The ends of the bent wire forming the T-shaped connector extend outward from the base of the "T" and then down into engagement with the clip 38.

Figure 4:
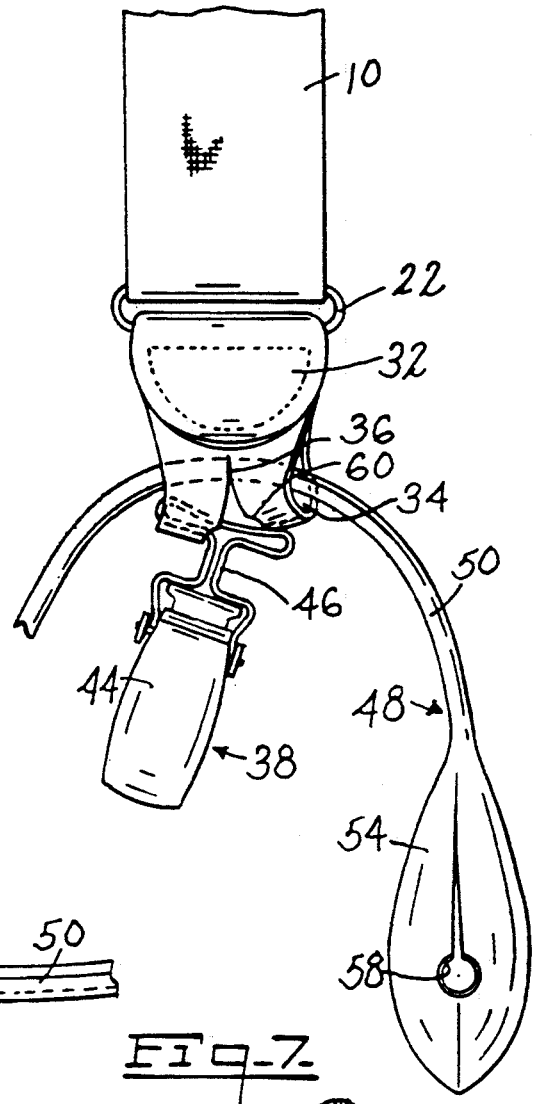
FIG. 4 is a detail front view of the suspender strap end showing the manner in which the clip end is removed from the clip carrier.

As can be seen in FIG. 4, the T-shaped connector with its smooth rounded ends on the arms permits the clip 38 to be easily disengaged from the clip carrier 32 leaving the button strap 48 in the clip carrier channel 34. This design is inexpensive to manufacture, and provides a clean appearance after the clip is removed because there are no buckles, snaps or buttons to undo in order to remove the clip end. With all of the clips removed, the combination suspenders is ready for use with the buttons on a pair of trousers in the manner shown in FIG. 1.

The button strap end 48 comprises a narrow central section 50 and wider opposite ends 52, 54 each of which is provided with a corresponding buttonhole, 56, 58. Buttonholes 56, 58 engage buttons on the inside surface of the waistband 28.

Button strap 48 is preferably formed of leather which is cut to the shape indicated and folded and sewn along the central section 50. The diameter of the clip carrier channel 34 is larger than the compressed diameter of the button strap 48 such that the button strap may be pulled from the clip carrier 32 in the manner illustrated in FIGS. 5 & 6. The diameter of the clip carrier channel 34 is sufficiently large that the button strap 48 may be removed even while the T-shaped connector is still engaged.

Figure 6:
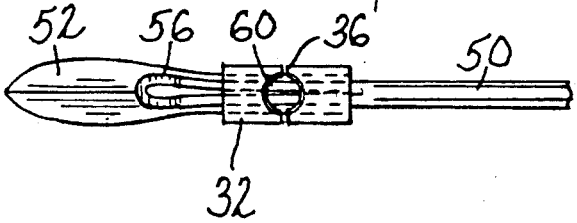
FIG. 6 is a detail view from the bottom of FIG. 5 showing the slit in the clip carrier.

As may be seen best in FIG. 6, the width of slit 36 in the clip carrier 32 is enlarged at the bottom of the clip carrier channel 34 at the point marked with reference numeral 60 to accept the width of the body of the T-shaped connector 46 where it vertically passes into the clip carrier channel 34. This enlarged opening allows the clip carrier to lie smoothly against the body while the suspenders are being worn, without bunching at the point where the T-shaped connector is attached. Moreover, it provides additional clearance for the rounded arm ends of the T-shaped connector as it is removed from the channel as shown in FIG. 4.

Figure 7:
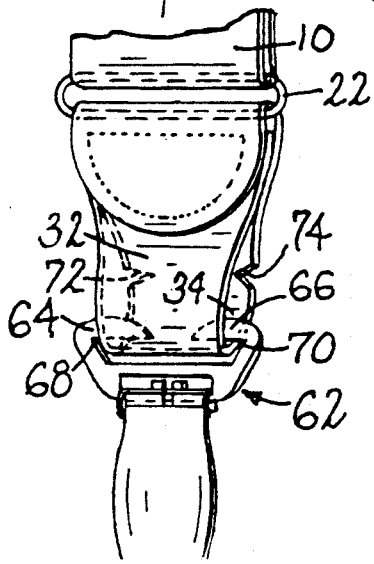
FIG. 7 is a detail view in perspective of an alternate embodiment of the clip and clip carrier.

FIG. 7 shows an alternative embodiment for the clip connector comprising a C-shaped connector 62 having a pair of inwardly extending horizontal arms 64, 66. The "C" lies on its back with the jaws being suspended therefrom and the arms being positioned at the top of the clip.

The clip carrier 32 is folded and sewn substantially as described above in connection with FIGS. 1–6, but lacks the vertical slit 36, which provides a neater appearance from the front. Arms 64, 66 extend into and are supported by the carrier channel 34 which extends between opposed inner edges of the "C" 68, 70.

The back side of the clip carrier 32 includes a pair of opposed V-shaped notches 72, 74 defining a narrow width section between the inwardly directed points of the V-notches. The narrow width section may be at any narrow width point along the clip carrier by compressing or folding the flexible clip carrier to bring the edges sufficiently close to permit the clip to be disengaged, or it may be formed by a single slit or notch in the clip carrier.

In the preferred design, the distance between an inner edge of the "C", e.g. edge 68, and the tip of an opposed arm, e.g. the tip of arm 66, is substantially the same as, or just slightly wider than, the distance across the narrow width section. This permits the clip to be removed by manipulating an inner edge of the C-shape 68, 70 into one of the V-shaped notches 72, 74, and rotating the tip of the opposed arm 64, 66 out of the other V-shaped notch.

Figure 5:
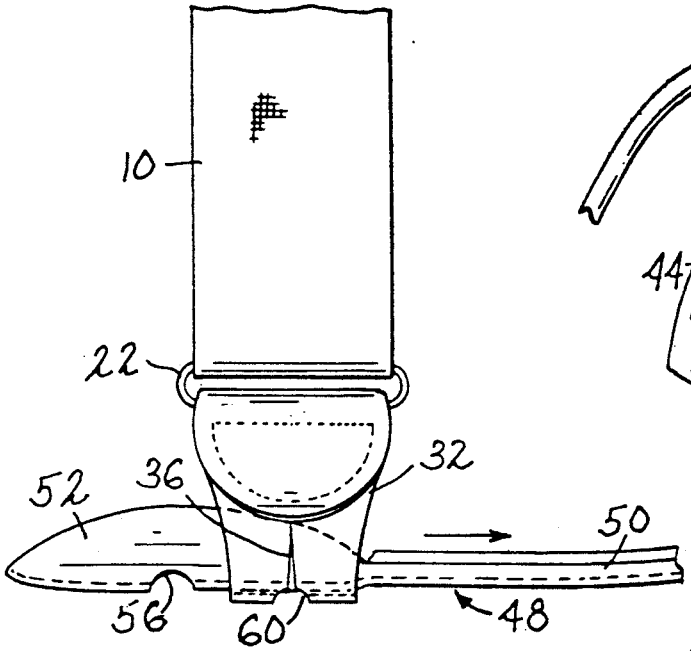
FIG. 5 is a detail front view of the suspender end showing the manner in which the button strap end is removed from the clip carrier.

The button end 48 may then be inserted into the clip carrier 32 in the same manner illustrated in FIGS. 5 & 6. Both clip connector designs are such that the clip may be engaged or disengaged while the button end 48 is inside the carrier channel 34, and the button end may be engaged or disengaged while the clip end is still engaged. The clip carrier 34 is permanently sewn closed and needs no buttons or snaps to open up the clip carrier channel to change the connector ends.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. Combination suspenders for use with button and buttonless trousers comprising:

a plurality of suspender straps, an end of each strap connected to a clip carrier resulting in a plurality of clip carriers, an upper end of each clip carrier being connected to a corresponding suspender strap, the lower end of each clip carrier comprising a horizontally folded flexible material permanently secured to itself to form a clip carrier channel having a substantially horizontal inner support surface, the clip carrier channel being vertically bisected into opposed halves by a slit, the slit extending upwardly perpendicular to the inner support surface on each side of the horizontal fold in the clip carrier;

a plurality of button straps, one for each clip carrier, each button strap having a central section extending through the clip carrier channel, and a buttonhole at each end, the compressed diameter of the button strap being less than the inside diameter of the channel so that the button strap may be removed from the channel; and a plurality of clips, one for each carrier, each clip having a pair of jaws at its lower end for connecting the clip to the waistband of a pair of trousers, and a clip connector, the clip connector being T-shaped, the base of the "T" being rigidly connected to the jaws, the body of the "T" extending vertically through the slit and the arms of the "T" extending horizontally outward into opposite halves of the clip carrier channel for support along their length by the inner support surface, the clips being removable from their corresponding clip carrier by spreading the slit to disengage the T-shaped connector.

2. Combination suspenders for use with button and buttonless trousers comprising:

a plurality of suspenders straps, an end of each strap connected to a clip carrier resulting in a plurality of clip carriers, an upper end of each clip carrier being connected to a corresponding suspender strap, the lower end of each clip carrier comprising a horizontally folded flexible material permanently secured to itself to form a clip carrier channel having a substantially horizontal inner support surface, a portion of the back side of the clip carrier forming a narrow width section;

a plurality of button straps, one for each clip carrier, each button strap having a central section extending through the clip carrier channel, and a buttonhole at each end, the compressed diameter of the button strap being less than the inside diameter of the channel so that the button strap may be removed from the channel; and a plurality of clips, one for each clip carrier, each clip having a pair of jaws at its lower end for connecting the clip to the waistband of a pair of trousers, and a C-shaped connector rigidly connected to the jaws, the connector having a pair of horizontal inwardly extending arms at its upper end, the arms of the connector extending into and being supported along their length on the inner support surface of the clip carrier channel, the clips being removable from their corresponding clip carrier by manipulating the flexible clip carrier to disengage the arms from the clip carrier at the narrow width section, the distance between the tip of an arm of the "C" and an opposed inner edge of the "C" being substantially the same as the width of the clip carrier at the narrow width section.

3. Combination suspenders according to claim 2 wherein the narrow width section is formed between a pair of V-shaped cuts in the back of the clip carrier.

4. Combination suspenders for use with button and buttonless trousers comprising:

a plurality of suspender straps, and end of each strap connected to a clip carrier resulting in a plurality of clip carriers, an upper end of each clip carrier being connected to a corresponding suspender strap, the lower end of each clip carrier comprising a horizontally folded flexible material forming a clip carrier channel, a portion of the back side of the clip carrier forming a narrow width section between a pair of V-shaped cuts;

a plurality of button straps, one for each clip carrier, each button strap having a central section extending through the clip carrier channel, and a buttonhole at each end, the compressed diameter of the button strap being less than the inside diameter of the channel so that the button strap may be removed from the channel; and a plurality of clips, one for each clip carrier, each clip having a pair of jaws at its lower end for connecting the clip to the waistband of a pair of trousers, and a C-shaped connector with a pair of horizontal inwardly extending arms at its upper end, the arms of the connector extending into and being supported by the clip carrier channel, the distance between the tip of an arm of the "C" and an opposed inner edge of the "C" being substantially the same as the width of the clip carrier at the narrow width section, the clips being removable from their corresponding clip carrier by manipulating the flexible clip carrier to disengage the arms from the clip carrier at the narrow width section.

* * * * *